US009984661B2

(12) United States Patent
Jin

(10) Patent No.: US 9,984,661 B2
(45) Date of Patent: May 29, 2018

(54) IMAGE DISPLAYING METHOD AND SYSTEM

(71) Applicants: Shanghai AVIC OPTO Electronics Co., Ltd., Shanghai (CN); Tianma Micro-Electronics Co., Ltd., Shenzhen (CN)

(72) Inventor: Huijun Jin, Shanghai (CN)

(73) Assignees: SHANGHAI AVID OPTO ELECTRONICS CO., LTD., Shanghai (CN); TIANMA MICRO-ELECTRONICS CO., LTD., Shenzhen (CN)

( * ) Notice: Subject to any disclaimer, the term of this patent is extended or adjusted under 35 U.S.C. 154(b) by 158 days.

(21) Appl. No.: 14/975,636

(22) Filed: Dec. 18, 2015

(65) Prior Publication Data

US 2016/0379601 A1 Dec. 29, 2016

(30) Foreign Application Priority Data

Jun. 29, 2015 (CN) ..... 2015 1 0372456

(51) Int. Cl.

| | |
|---|---|
| ***G09G 5/00*** | (2006.01) |
| ***G09G 5/14*** | (2006.01) |
| ***G09G 5/38*** | (2006.01) |
| ***G09G 3/00*** | (2006.01) |

(52) U.S. Cl.

CPC ..... *G09G 5/14* (2013.01); *G09G 3/003* (2013.01); *G09G 5/38* (2013.01); *G09G 2320/028* (2013.01); *G09G 2320/0261* (2013.01); *G09G 2320/068* (2013.01)

(58) Field of Classification Search

None

See application file for complete search history.

(56) References Cited

U.S. PATENT DOCUMENTS

| | | | | |
|---|---|---|---|---|
| 2013/0321260 | A1 | 12/2013 | Joo | |
| 2014/0184656 | A1* | 7/2014 | Tian | G09G 3/36 345/690 |
| 2014/0267176 | A1 | 9/2014 | Bathiche et al. | |
| 2015/0002531 | A1 | 1/2015 | Park et al. | |

FOREIGN PATENT DOCUMENTS

| | | | |
|---|---|---|---|
| CN | 1549240 | A | 11/2004 |
| CN | 101027679 | B | 8/2007 |

* cited by examiner

*Primary Examiner* — M Good Johnson

(74) *Attorney, Agent, or Firm* — Faegre Baker Daniels LLP

(57) ABSTRACT

An image displaying method and system. The method includes: obtaining an image to be displayed, and dividing equally the image to be displayed into a plurality of first sub-images along a first direction; obtaining position information of a view point relative to the flat display and parameter information of a first virtual section line segment of the flat display; calculating a compensation ratio along the first direction for each first sub-image of the image to be displayed, according to the position information of the view point relative to the flat display and the parameter information of the first virtual section line segment; and compensating each first sub-image of the image along the first direction, and displaying the compensated first sub-image on the flat display, so that visual angles at the view point with respect to the compensated first sub-images are the same.

17 Claims, 6 Drawing Sheets

IMAGE DISPLAYING METHOD AND SYSTEM

CROSS-REFERENCE TO RELATED APPLICATION

This application claims priority to Chinese Application No. 201510372456.5, filed Jun. 29, 2015, which is herein incorporated by reference in its entirety.

TECHNICAL FIELD

The present disclosure relates to the field of display technologies and, in particular, to an image displaying method and system.

BACKGROUND

Electronic display devices have been widely used in various electronic appliances, such as a liquid crystal television, a liquid crystal display, a digital poster board, a laptop computer, a personal digital assistance (PDA), a mobile phone, a digital camera and an electronic book reader. Previously, a flat display, such as a flat television and a flat liquid crystal display, was dominant among display devices. However, a display effect of the flat display is not perfect, because visual angles corresponding to line segments of the same length displayed on the flat display are different no matter where a viewer is in front of the flat display, and hence the viewer perceives that the line segments have different lengths. A curved-surface display has been proposed, and a difference between the curved-surface display (such as, a curved-surface television) and the flat display is that: for a viewer at a proper position, the visual angles for objects of a unit length displayed on the curved-surface display are identical to each other, while the visual angles for the objects of a unit length displayed on the flat display are different. Therefore, the display effect of the flat display is inferior to that of the curved-surface display. Due to difficulties in the process for manufacturing the curved-surface display, the manufacturing cost of the existing curved-surface display is rather expensive.

SUMMARY

The disclosure provides an image displaying method and system so that the visual angels viewed by a viewer located at any view point in front of the flat display with respect to the same line segment of the image to be displayed along a first direction are equal, thus the display effect of the curved-surface display is achieved by the flat display, thereby reducing manufacturing cost of the flat display.

In a first example, embodiments of the disclosure provide an image displaying method, including:

obtaining an image to be displayed on a flat display, and dividing equally the image to be displayed into a plurality of first sub-images along a first direction parallel to a display surface of the flat display;

obtaining position information of a view point relative to the flat display and parameter information of a first virtual section line segment of the flat display, wherein the first virtual section line segment has two endpoints located on a frame of the flat display, is extended along the first direction, and is extended through a projection of the view point onto the flat display;

calculating a compensation ratio along the first direction for each first sub-image of the image to be displayed, according to the position information of the view point relative to the flat display and the parameter information of the first virtual section line segment; and compensating each first sub-image of the image along the first direction according to the compensation ratio along the first direction for the first sub-image of the image, and displaying the compensated first sub-image on the flat display, so that visual angles at the view point with respect to the compensated first sub-images are equal.

In a second example, embodiments of the disclosure provide an image displaying system, including a flat display, a position detector and an image compensation chip; wherein the position detector is disposed on a frame of the flat display and configured to obtain position information of a view point relative to the flat display; the image compensation chip is disposed on a driving panel of the flat display and configured to: divide equally an image to be displayed on the flat display into a plurality of first sub-images along a first direction parallel to a display surface of the flat display; calculate a compensation ratio along the first direction for each first sub-image of the image to be displayed according to the position information of the view point relative to the flat display and parameter information of a first virtual section line segment of the flat display; and compensate each first sub-image of the image along the first direction, wherein the first direction is parallel to the display surface of the flat display, and the first virtual section line segment has two endpoints located on the frame of the flat display, is extended along the first direction, and is extended through a projection of the view point onto the flat display; and the flat display is configured to display the compensated first sub-images so that visual angles at the view point for the compensated first sub-images are equal.

The disclosure divides equally the image to be displayed into a plurality of first sub-images along a first direction, obtains position information of a view point relative to the flat display and parameter information of a first virtual section line segment of the flat display, calculates a compensation ratio along the first direction for each first sub-image of the image to be displayed, compensates each first sub-image of the image along the first direction, and displays the compensated first sub-image on the flat display, so that visual angles at the view point with respect to the compensated first sub-images are equal, thus the display effect of the curved-surface display is achieved by the flat display, thereby reducing manufacturing cost of the flat display.

While multiple embodiments are disclosed, still other embodiments of the disclosure will become apparent to those skilled in the art from the following detailed description, which shows and describes illustrative embodiments of the disclosure. Accordingly, the drawings and detailed description are to be regarded as illustrative in nature and not restrictive.

Figure 1:
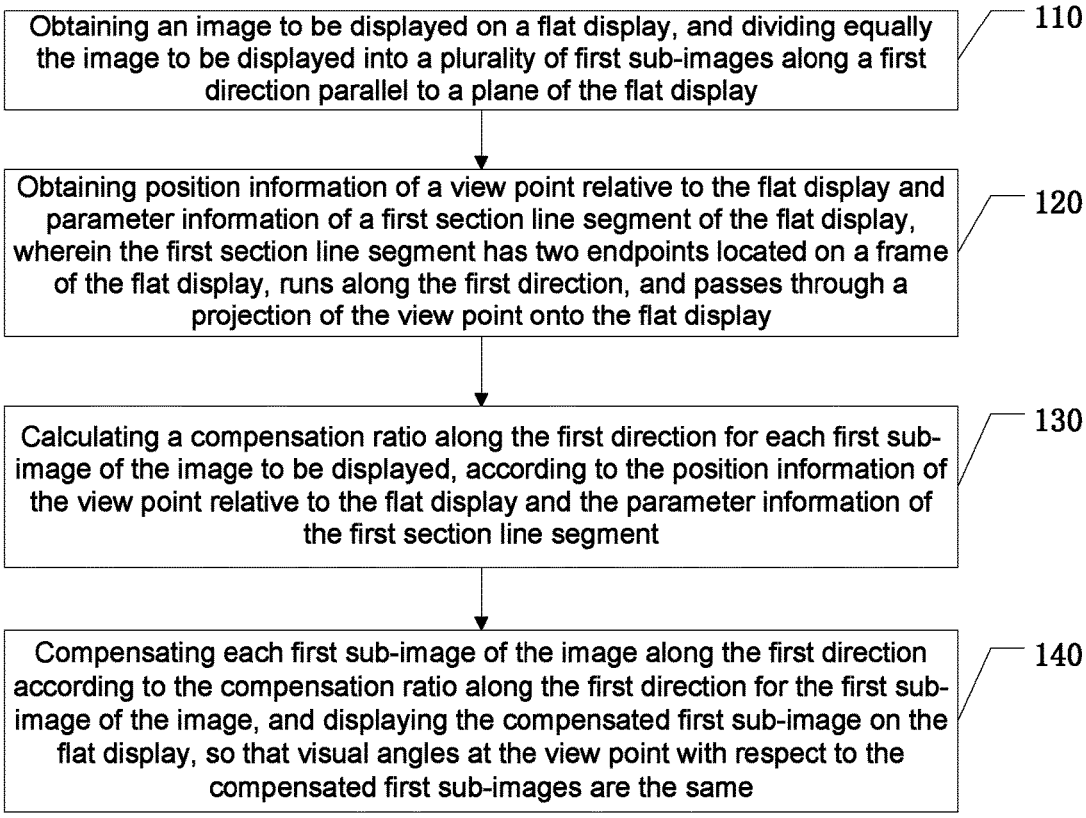
FIG. 1 is a schematic flow diagram showing an image displaying method, according to embodiments of the disclosure.

While the disclosure is amenable to various modifications and alternative forms, specific embodiments have been shown by way of example in the drawings and are described in detail below. The intention, however, is not to limit the disclosure to the particular embodiments described. On the contrary, the disclosure is intended to cover all modifications, equivalents, and alternatives falling within the scope of the disclosure as defined by the appended claims.

DETAILED DESCRIPTION

The disclosure will be further illustrated through specific embodiments below in conjunction with the accompanying drawings. It may be understood that specific embodiments described herein are merely for explaining the disclosure rather than limiting the disclosure. In addition, it should be illustrated that merely partial content associated with the disclosure rather than all content is illustrated in the accompanying drawings for ease of description.

Embodiments of the disclosure provide an image displaying method, and FIG. 1 is a schematic flow diagram showing an image displaying method, according to embodiments of the disclosure. As shown in FIG. 1, the method includes Steps 110 to 140 below.

Step 110 includes obtaining an image to be displayed on a flat display, and dividing equally the image to be displayed into a plurality of first sub-images along a first direction parallel to a display surface of the flat display.

Figure 2:
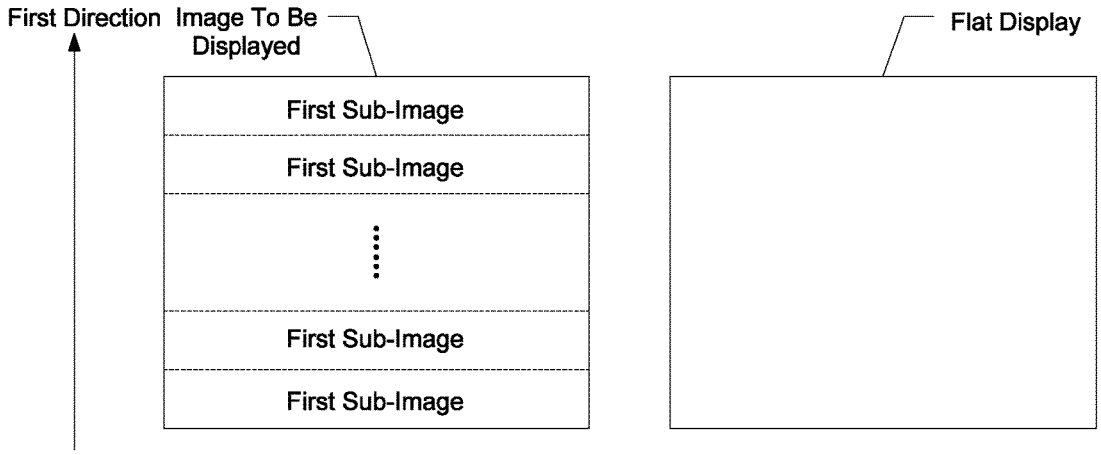
FIG. 2 is a schematic diagram showing equal division of the image along the first direction, according to embodiments of the disclosure.

FIG. 2 is a schematic diagram showing equal division of the image along the first direction, according to embodiments of the disclosure. For example, if the flat display is rectangular, the first direction is set to be parallel to a side of the flat display, and the obtained image to be displayed is divided into a plurality of first sub-images along the first direction, each first sub-image having the same length in the first direction. It is noted that FIG. 2 is merely an example for the sake of describing the implementation of Step 110 rather than a limitation to the embodiments of the disclosure. Besides rectangle, the flat display can further have other shapes. Embodiments of the disclosure make no limitation to the shape of the flat display, as long as it is ensured that the first direction can be parallel to the display surface of the flat display.

Step 120 includes obtaining position information of a view point relative to the flat display and parameter information of a first virtual section line segment of the flat display, where the first virtual section line segment has two endpoints located on a frame of the flat display, is extended along the first direction, and is extended through a projection of the view point onto the flat display.

Figure 3:
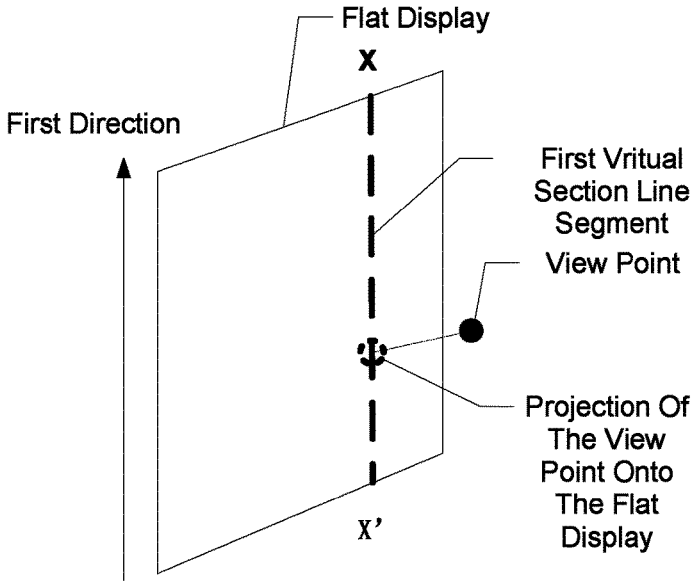
FIG. 3 is a schematic diagram of the first virtual section line segment of the flat display, according to embodiments of the disclosure.

FIG. 3 is a schematic diagram of the first virtual section line segment of the flat display, according to embodiments of the disclosure. As shown in FIG. 3, the first virtual section line segment (i.e. a dotted line XX') is parallel to the first direction and is extended through a projection of the view point onto the flat display. The first virtual section line segment has two endpoints located on the frame of the flat display. The parameter information of the first virtual section line segment of the flat display can include information such as the length of the first virtual section line segment or coordinates of endpoints of the first virtual section line segment.

Step 130 includes calculating a compensation ratio along the first direction for each first sub-image of the image to be displayed, according to the position information of the view point relative to the flat display and the parameter information of the first virtual section line segment.

The compensation ratio along the first direction for each first sub-image of the image to be displayed is calculated according to the position information of the view point relative to the flat display (such as coordinates of the position of the view point and a distance from the view point to the flat display) and the parameter information of the first virtual section line segment (such as the length of the first virtual section line segment and coordinates of endpoints of the first virtual section line segment).

Step 140 includes compensating each first sub-image of the image along the first direction according to the compensation ratio along the first direction for the first sub-image of the image, and displaying the image on the flat display, so that visual angles at the view point with respect to the compensated first sub-images are equal, i.e., the same.

Figure 4:
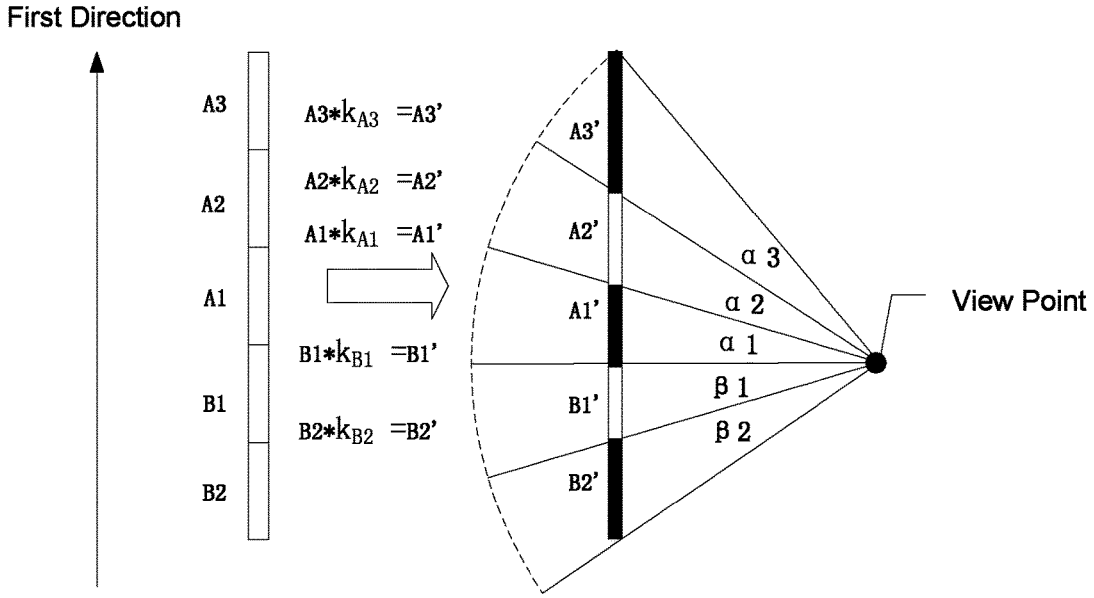
FIG. 4 is a schematic diagram showing the compensation for each first sub-image of the image to be displayed along the first direction, according to embodiments of the disclosure.

As such, after the compensation ratio along the first direction for each first sub-image of the image to be displayed is calculated in Step 130, each first sub-image of the image is compensated along the first direction according to the compensation ratio, so that visual angles at the view point with respect to the compensated first sub-images are equal. FIG. 4 is a schematic diagram showing the compensation for each first sub-image of the image to be displayed along the first direction, according to embodiments of the disclosure, and shows a sectional view taken along the first virtual section line segment XX' of FIG. 3. As shown in FIG. 4, illustratively, the image to be displayed is divided equally into five first sub-images B2, B1, A1, A2 and A3 along the first direction, and the lengths of the five first sub-images B2, B1, A1, A2 and A3 along the first direction are identical. The compensation ratios along the first direction for the first sub-images B2, B1, A1, A2 and A3 are calculated in Step 130 as $k_{B2}$, $k_{B1}$, $k_{A1}$, $k_{A2}$ and $k_{A3}$, respectively, so that compensated first sub-images B2', B1', A1', A2' and A3' are obtained through multiplying the lengths of the first sub-images B2, B1, A1, A2 and A3 along the first direction by the corresponding compensation ratios $k_{B2}$, $k_{B1}$, $k_{A1}$, $k_{A2}$ and $k_{A3}$ along the first direction. Referring to FIG. 4, visual angles $\beta 2$, $\beta 1$, $\alpha 1$, $\alpha 2$ and $\alpha 3$ at the view point corresponding to the respective lengths of the compensated first sub-images B2', B1', A1', A2' and A3' along the first direction are equal. Regardless of whether the view point aligns with the center of the flat display or not, it can be implemented that the visual angles for the compensated first sub-images along the first direction are identical, i.e. the display effect of the curved-surface display is achieved by the flat display.

It is noted that FIG. 4, illustratively, shows equal division of the image to be displayed into five first sub-images, which is not to be understood as a limitation to the disclosure. Embodiments of the disclosure make no limitation to the number of the first sub-images equally divided by the image to be displayed along the first direction, and the higher the number of the first sub-images of the image is, the finer the image as displayed will be, and the better the display effect of the flat display will be.

On the basis of the above embodiments, the size of each compensated first sub-image of the image along the first direction is larger than or equal to the size of one sub-pixel of the flat display along the first direction. In embodiments, illustratively, one pixel generally includes a plurality of sub-pixels, for example, one pixel includes a red sub-pixel, a blue sub-pixel and a green sub-pixel. In such configurations, advantageously, each compensated first sub-image of the image can be completely displayed on the display device, thus avoiding the problem that some region cannot be displayed since the compensated first sub-image of the image is smaller than the size of one sub-pixel, because the first sub-images equally divided from the image along the first direction are excessive.

Embodiments of the disclosure further provide an image display method, which is based on the above embodiments and is an optimized variant of the above embodiments, and the method further includes:

Step 210 includes dividing equally the image to be displayed into a plurality of second sub-images along a second direction parallel to the display surface of the flat display and perpendicular to the first direction;

Step 220 includes obtaining parameter information of a second virtual section line segment of the flat display, where the second virtual section line segment has two endpoints located on the frame of the display device, is extended along the second direction, and is extended through a projection of the view point onto the flat display;

Step 230 includes calculating a compensation ratio along the second direction for each second sub-image of the image according to the position information of the view point relative to the flat display and the parameter information of the second virtual section line segment; and Step 240 includes compensating each second sub-image of the image along the second direction according to the compensation ratio along the second direction for the second sub-image of the image, and displaying the image on the flat display, so that visual angles at the view point with respect to the compensated second sub-images are equal.

It should be noted that, Step 210, Step 220, Step 230 and Step 240 may be performed simultaneously with Step 110, Step 120, Step 130 and Step 140, respectively, or Step 210, Step 220, Step 230 and Step 240 may be performed alternatively with Step 110, Step 120, Step 130 and Step 140.

Figure 5:
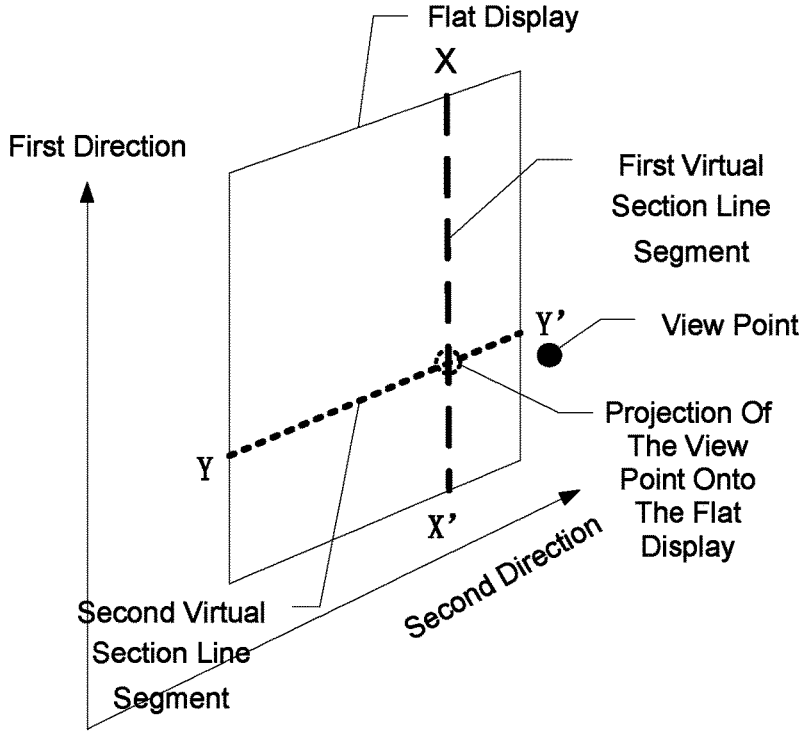
FIG. 5 is a schematic diagram showing the first virtual section line segment and the second virtual section line segment of a flat display, according to embodiments of the disclosure.

FIG. 5 is a schematic diagram showing the first virtual section line segment and the second virtual section line segment of a flat display. As shown in FIG. 5, the first virtual section line segment (the dotted line XX' in FIG. 5) is parallel to the first direction and is extended through the projection of the view point onto the flat display, and the second virtual section line segment (the dotted line YY' in FIG. 5) is parallel to the second direction and is extended through the projection of the view point onto the flat display.

Figure 6:
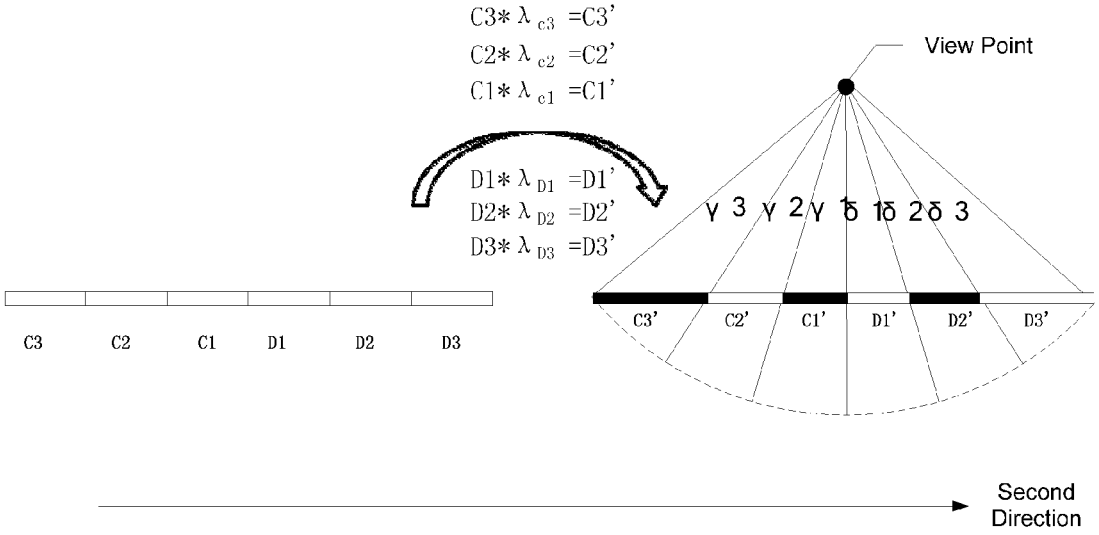
FIG. 6 is a schematic diagram showing the compensation along the second direction for each second sub-image of an image to be displayed, according to embodiments of the disclosure.

FIG. 6 is a schematic diagram showing the compensation along the second direction for each second sub-image of an image to be displayed, according to embodiments of the disclosure, and shows a sectional view taken along the second virtual section line segment YY' in FIG. 5. In embodiments of the disclosure, in addition that each first sub-image of the image to be displayed is compensated along the first direction, each second sub-image of the image is compensated along the second direction. As for the compensation for each first sub-image of the image to be displayed along the first direction, reference can be made to FIG. 4 and the corresponding description, which will not be described again here. As shown in FIG. 6, illustratively, the image to be displayed is divided equally into six second sub-images C3, C2, C1, D1, D2 and D3 along the second direction, and the lengths of the six second sub-images along the second direction are equal to each other. The compensation ratios along the second direction for the second sub-images C3, C2, C1, D1, D2 and D3 are calculated in Step 230 as $\lambda_{C3}$, $\lambda_{C2}$, $\lambda_{C1}$, $\lambda_{D1}$, $\lambda_{D2}$ and $\lambda_{D3}$, respectively, so that compensated second sub-images C3', C2', C1', D1', D2', D3' are obtained through multiplying the lengths of the second sub-images C3, C2, C1, D1, D2, D3 along the second direction by the corresponding compensation ratios $\lambda_{C3}$, $\lambda_{C2}$, $\lambda_{C1}$, $\lambda_{D1}$, $\lambda_{D2}$ and $\lambda_{D3}$ along the second direction. Visual angles $\gamma 3$, $\gamma 2$, $\gamma 1$, $\delta 1$, $\delta 2$, $\delta 3$ at the view point corresponding to the respective lengths of the compensated second sub-images C3', C2', C1', D1', D2', D3' along the second direction are equal. Regardless of whether the view point aligns with the center of the flat display or not, it can be implemented that the visual angles for the compensated second sub-images along the second direction are identical. Therefore, embodiments of the disclosure can make the flat display simultaneously achieve the display effect of the curved-surface display in both the first direction and the second direction. It is noted that FIG. 6, illustratively, shows equal division of the image to be displayed into six second sub-images, which is not intended as a limitation to the disclosure. Embodiments of the disclosure makes no limitation to the number of the second sub-images equally divided by the image to be displayed along the second direction, and the higher the number of the second sub-images of the image is, the finer the image as displayed will be, and the better the display effect of the flat display will be.

On the basis of the above embodiments, further, the size of each compensated second sub-image of the image along the second direction is larger than or equal to the size of one sub-pixel of the flat display along the second direction. In such configuration, advantageously, each compensated second sub-image of the image can be completely displayed on the flat display, thus avoiding the problem that some region cannot be displayed since the compensated second sub-images of the image is smaller than the size of one sub-pixel, because the second sub-images divided equally from the image along the second direction are excessive On the basis of the above embodiments, optionally, the position information of the view point relative to the flat display can be obtained by a position detector. In particular, position information of the view point relative to the flat display can be obtained by at least two cameras.

Figure 7:
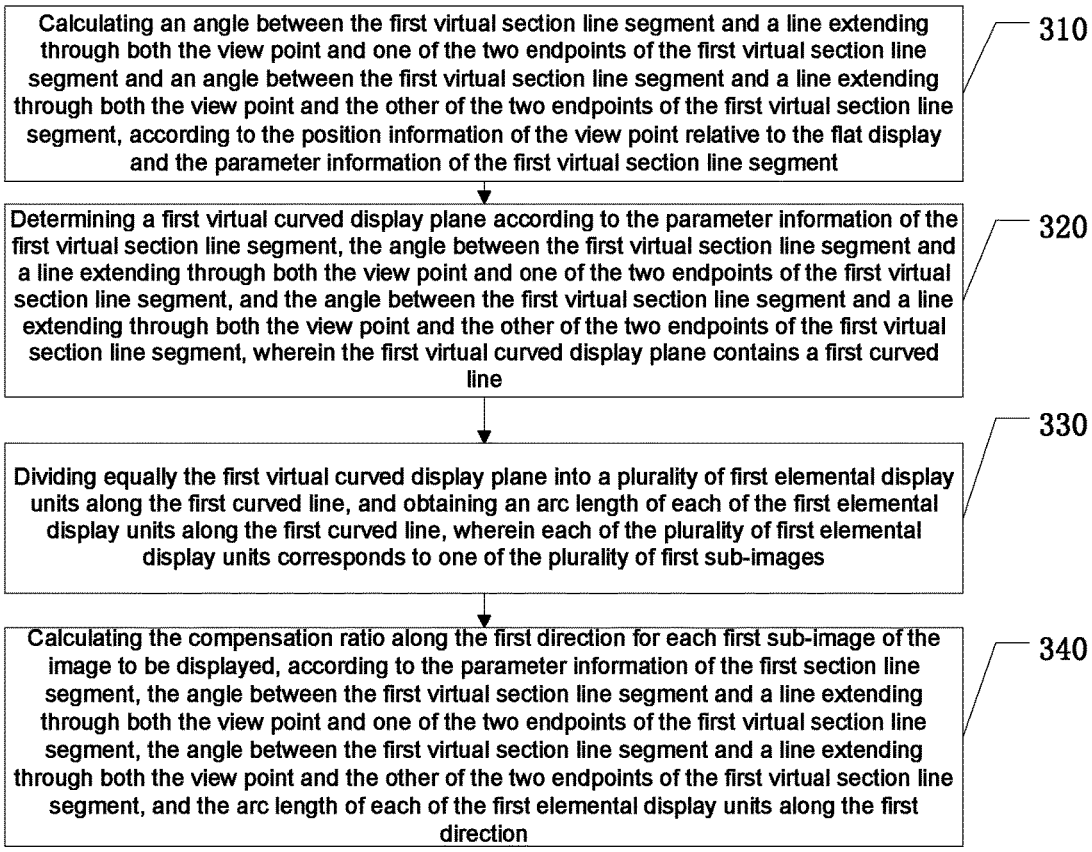
FIG. 7 is a schematic flow diagram of calculating the compensation ratio along a first direction for each first sub-image of an image to be displayed, according to embodiments of the disclosure.

On the basis of the above embodiments, embodiments of the disclosure provide a method for calculating the compensation ratio along a first direction for each first sub-image of an image to be displayed, and FIG. 7 is a schematic flow diagram of calculating the compensation ratio along a first direction for each first sub-image of an image to be displayed, according to embodiments of the disclosure. As shown in FIG. 7, the method includes Steps 310 to 340 below.

Step 310 includes calculating an angle between the first virtual section line segment and a line extending through both the view point and one of the two endpoints of the first virtual section line segment and an angle between the first virtual section line segment and a line extending through both the view point and the other of the two endpoints of the first virtual section line segment, according to the position information of the view point relative to the flat display and the parameter information of the first virtual section line segment.

Figure 8:
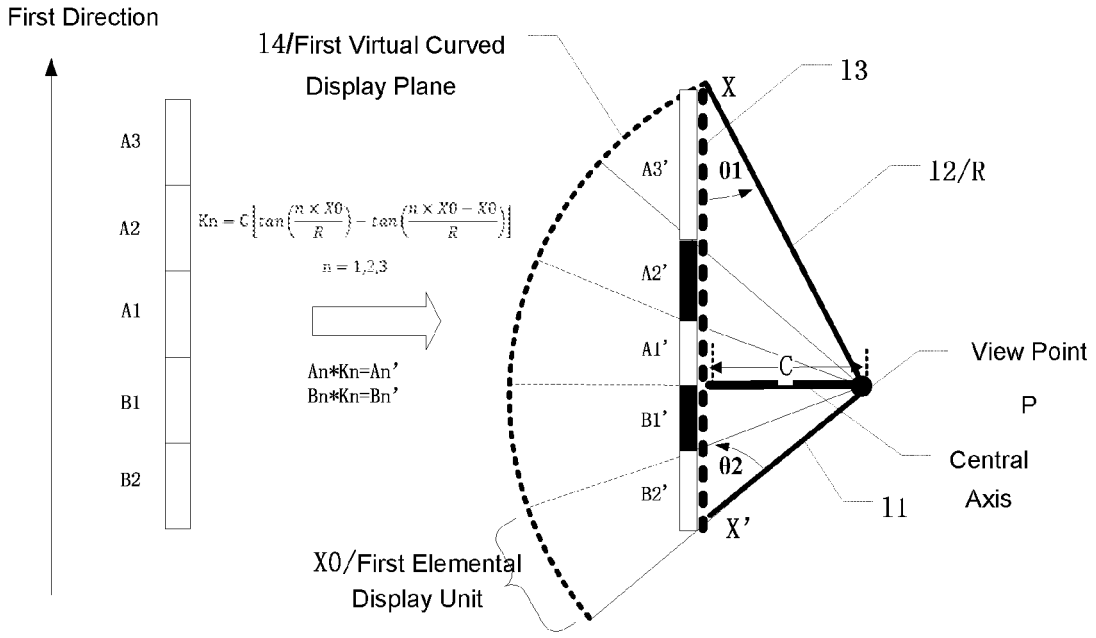
FIG. 8 is a schematic diagram showing a method for calculating the compensation ratio along the first direction for each first sub-image of an image to be displayed, according to embodiments of the disclosure.

FIG. 8 is a schematic diagram showing a method for calculating the compensation ratio along the first direction for each first sub-image of an image to be displayed. As shown in FIG. 8, an angle θ2 is formed between the first virtual section line segment l3 and the line l1 connecting the view point P to the endpoint of the first virtual section line segment l3, and the angle θ1 is formed between the first virtual section line segment l3 and the line l2 connecting the view point P to the other endpoint of the first virtual section line segment l3. In particular, the position information of the view point relative to the flat display can be obtained by at least two cameras, and the angles θ1 and θ2 are calculated by the parameter information of the first virtual section line segment.

Step 320 includes determining a first virtual curved display plane according to the parameter information of the first virtual section line segment, the angle between the first virtual section line segment and a line extending through both the view point and one of the two endpoints of the first virtual section line segment, and the angle between the first virtual section line segment and a line extending through both the view point and the other of the two endpoints of the first virtual section line segment, where, the first virtual curved display plane contains a first curved line.

As shown in FIG. 8, the first virtual curved display plane corresponding to the flat display is determined according to the angles θ1 and θ2 and the parameter information of the first virtual section line segment l3. With reference to FIG. 8, an edge of the first virtual curved display plane overlaps an edge of the flat display and contains the first curved line 14.

Step 330 includes dividing equally the first virtual curved display plane into a plurality of first elemental display units along the first curved line, and obtaining the arc length of each of the first elemental display units along the first curved line, where each of the plurality of first elemental display units corresponds to one of the plurality of first sub-images.

Step 340 includes calculating the compensation ratio along the first direction for each first sub-image of the image to be displayed, according to the parameter information of the first virtual section line segment, the angle between the first virtual section line segment and a line extending through both the view point and one of the two endpoints of the first virtual section line segment, the angle between the first virtual section line segment and a line extending through both the view point and the other of the two endpoints of the first virtual section line segment, and the arc length of each of the first elemental display units along the first direction.

As shown in FIG. 8, the first virtual curved display plane is equally divided into a plurality of first elemental display units along the first curved line 14, each of the plurality of first elemental display units has an arc length of X0 along the first curved line 14, and each of the plurality of first elemental display units corresponds to one of the first sub-images. For sake of description, FIG. 8 illustratively shows five first elemental display units. The compensation ratio Bn along the first direction for each first sub-image of the image to be displayed is calculated according to the parameter information of the first virtual section line segment (the length l3 of the first virtual section line segment), the angle θ1 between the first virtual section line segment and a line extending through both the view point and one of the two endpoints of the first virtual section line segment, the angle θ2 between the first virtual section line segment and a line extending through both the view point and the other of the two endpoints of the first virtual section line segment, and the arc length X0 of each of the first elemental display units along the first direction. Then the length of each first sub-image of the image along the first direction is compensated through multiplying the length of the first sub-image of the image along the first direction by the corresponding compensation ratio k, so that visual angles for the compensated first sub-images along the first direction are equal.

On the basis of the above embodiments, optionally, the Step 340 of calculating the compensation ratio along the first direction for each first sub-image of the image to be displayed, according to the parameter information of the first virtual section line segment, the angle between the first virtual section line segment and a line extending through both the view point and one of the two endpoints of the first virtual section line segment, the angle between the first virtual section line segment and a line extending through both the view point and the other of the two endpoints of the first virtual section line segment, and the arc length of each of the first elemental display units along the first direction can include Steps 341 to 343 below.

Step 341 includes calculating a curvature radius of the first virtual curved display plane and the distance from the view point to the flat display, according to the parameter information of the first virtual section line segment, the angle between the first virtual section line segment and a line extending through both the view point and one of the two endpoints of the first virtual section line segment, and the angle between the first virtual section line segment and a line extending through both the view point and the other of the two endpoints of the first virtual section line segment.

Referring to FIG. 8, the length of a side l1 opposite to the angle θ1 is calculated as $$11 = \frac{L1 \cdot \sec\theta 2}{\frac{\tan\theta 2}{\tan\theta 1} + 1},$$

the length of a side l2 opposite to the angle θ2 is calculated as $$12 = \frac{L1 \cdot \sec\theta 1}{\frac{\tan\theta 1}{\tan\theta 2} + 1},$$

and the distance C from the view point to the flat display is calculated as $$C = \frac{L1 \cdot \tan\theta 1}{\frac{\tan\theta 1}{\tan\theta 2} + 1} = \frac{L1 \cdot \tan\theta 2}{\frac{\tan\theta 2}{\tan\theta 1} + 1}.$$

The maximum value between l1 and l2 i.e. the longer side of both the sides l1 and l2 is used as the radius R of the first virtual curved display plane. Illustratively, provided l2>l1 and $$R = 12 = \frac{L1 \cdot \sec\theta 1}{\frac{\tan\theta 1}{\tan\theta 2} + 1},$$

then the first virtual curved display plane is a curved plane which has a center point located at the view point P and a radius R, and contains the first curved line 14.

Step 342 includes determining a positioning sequence number of each first sub-image of the image along the first direction according to the parameter information of the first virtual section line segment, the angle between the first virtual section line segment and a line extending through both the view point and one of the two endpoints of the first virtual section line segment, the angle between the first virtual section line segment and a line extending through both the view point and the other of the two endpoints of the first virtual section line segment.

In embodiments of the disclosure, the view point may align with the center of the flat display or be deviated from the center of the flat display, and a positioning sequence number of each first sub-image of the image along the first direction can be determined according to the parameter information of the first virtual section line segment (such as position coordinates of the view point in relation to the flat display), the angle θ2 between the first virtual section line segment l3 and a line l1 extending through both the view point and one of the two endpoints of the first virtual section line segment l3, the angle θ1 between the first virtual section line segment l3 and a line l2 extending through both the view point and the other of the two endpoints of the first virtual section line segment l3. As shown in FIG. 8, taking a line connecting the view point P with the projection of the view point P onto the flat display as a central axis and starting from the projection, the first sub-images A1, A2 and A3 are arranged and numbered in sequence along the first direction, and the first sub-images B1 and B2 are arranged and numbered in sequence along a direction opposite to the first direction. It should be noted that, in FIG. 8, five first sub-images are provided illustratively for ease of description, but the embodiments of the disclosure are not limited thereto. Given that the first sub-images of the image to be displayed are arranged along the first direction, the line is used as the central axis and the projection is used as a start point, the first sub-images are arranged and numbered in sequence along the first direction and a direction opposite thereto, respectively. For example, if M first sub-images are arranged along the first direction starting from the projection, and N first sub-images are arranged along a direction opposite to the first direction starting from the projection, the positioning sequence numbers of the first sub-images along the first direction are set as BN, BN−1, BN−2, B2, B1, A1, A2, . . . , AM−1, AM, where, M and N are both integers larger than 1.

Step 343 includes calculating the compensation ratio along the first direction for each first sub-image of the image to be displayed, according to the positioning sequence number of each first sub-image of the image along the first direction, the curvature radius of the first virtual curved display plane, the distance from the view point to the flat display, and the arc length of each of the first elemental display units along the first direction.

Given the positioning sequence number of each first sub-image of the image to be displayed along the first direction, the curvature radius R of the first virtual curved display plane, the distance C from the view point to the flat display, and the arc length X0 of each of the first elemental display units along the first direction, the compensation ratio k may be calculated as follows:

$$Kn = C\left[\tan\left(\frac{n \times X0}{R}\right) - \tan\left(\frac{n \times X0 - X0}{R}\right)\right],$$

where n is a positive integer, and n∈[1, N] or n∈[1, M], and

Herein, n represents the positioning sequence number of the first sub-image of the image along the first direction, for example, the compensation ratio Kx for the first sub-image $B_x$ along the first direction is calculated as:

$$Kx = C\left[\tan\left(\frac{x \times X0}{R}\right) - \tan\left(\frac{x \times X0 - X0}{R}\right)\right],$$

x is a positive integer in the range of 1 to N.

On the basis of the above embodiments, embodiments of the disclosure provide a method for calculating the compensation ratio along the second direction for each second sub-image of the image to be displayed, which can include:

Step 410 includes calculating the angle between the second virtual section line segment and a line extending through both the view point and one of the two endpoints of the second virtual section line segment, and the angle between the second virtual section line segment and a line extending through both the view point and the other of the two endpoints of the second virtual section line segment, according to the position information of the view point relative to the flat display and the parameter information of the second virtual section line segment;

Step 420 includes determining a second virtual curved display plane according to the parameter information of the second virtual section line segment, the angle between the second virtual section line segment and the line extending through both the view point and one of the two endpoints of the second virtual section line segment, and the angle between the second virtual section line segment and the line extending through both the view point and the other of the two endpoints of the second virtual section line segment, where, the second virtual curved display plane contains the second curved line;

Step 430 includes dividing equally the second virtual curved display plane into a plurality of second elemental display units along a second direction, and obtaining the arc length of each of the second elemental display units along the second direction, where each of the plurality of second elemental display units corresponds to one of the plurality of second sub-images; and Step 440 includes calculating a compensation ratio along the second direction for each second sub-image of the image to be displayed, according to the parameter information of the second virtual section line segment, the angle between the second virtual section line segment and the line extending through both the view point and one of the two endpoints of the second virtual section line segment, the angle between the second virtual section line segment and the line extending through both the view point and the other of the two endpoints of the second virtual section line segment, and the arc length of each of the second elemental display units along the second direction.

Further, the Step 440 includes calculating a compensation ratio along the second direction for each second sub-image of the image to be displayed, according to the parameter information of the second virtual section line segment, the angle between the second virtual section line segment and the line extending through both the view point and one of the two endpoints of the second virtual section line segment, the angle between the second virtual section line segment and the line extending through both the view point and the other of the two endpoints of the second virtual section line segment, and the arc length of each of the second elemental display units along the second direction includes:

Step 441 includes calculating a curvature radius of the second virtual curved display plane, according to the parameter information of the second virtual section line segment, the angle between the second virtual section line segment and a line extending through both the view point and one of the two endpoints of the second virtual section line segment, and the angle between the second virtual section line segment and a line extending through both the view point and the other of the two endpoints of the second virtual section line segment;

Step 442 includes determining a positioning sequence number of each second sub-image of the image along the second direction according to the parameter information of the second virtual section line segment, the angle between the second virtual section line segment and a line extending through both the view point and one of the two endpoints of the second virtual section line segment, the angle between the second virtual section line segment and a line extending through both the view point and the other of the two endpoints of the second virtual section line segment; and Step 443 includes calculating the compensation ratio along the second direction for each second sub-image of the image to be displayed, according to the positioning sequence number of each second sub-image of the image along the second direction, the curvature radius of the second virtual curved display plane, the distance from the view point to the flat display, and the arc length of each of the second elemental display units along the second direction.

It is noted that the method for calculating the compensation ratio along the second direction for each second sub-image of the image to be displayed is similar to the method for calculating the compensation ratio along the first direction for each first sub-image of the image to be displayed, which is not repeated here.

Figure 9:
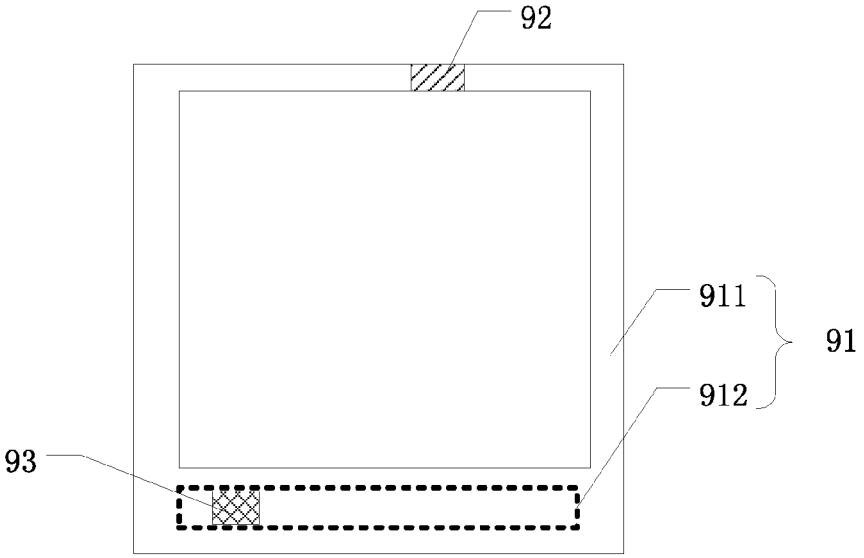
FIG. 9 is a schematic diagram showing the structure of an image displaying system, according to embodiments of the disclosure.

Embodiments of the disclosure further provide an image displaying system, and FIG. 9 is a schematic diagram showing the structure of an image displaying system, according to embodiments of the disclosure. As shown in FIG. 9, the image displaying system includes a flat display 91, a position detector 92 and an image compensation chip 93.

The position detector 92 disposed on a frame 911 of the flat display 91 is configured to obtain position information of a view point P in relation to the flat display 91.

The image compensation chip 93 is disposed on a driving panel 912 of the flat display 91 and configured to: divide equally an image to be displayed into a plurality of first sub-images along a first direction; calculate a compensation ratio along the first direction for each first sub-image of the image to be displayed according to the position information of the view point P relative to the flat display 91 and the parameter information of a first virtual section line segment of the flat display 91; and compensate each first sub-image of the image along the first direction, where, the first direction is parallel to the display surface of the flat display, the first virtual section line segment has two endpoints located on the frame of the flat display, is extended along the first direction, and is extended through a projection of the view point onto the flat display 91.

The flat display 91 is configured to display the compensated first sub-images so that visual angles at the view point for the compensated first sub-images are equal.

In embodiments of the disclosure, each first sub-image of the image to be displayed is compensated in the first direction of the flat display so that the visual angles for the compensated first sub-images along the first direction are identical, thus the display effect of the curved-surface display is achieved by the flat display.

On the basis of the above embodiments, optionally, the position detector includes at least two cameras. The position information of the view point in relative to the flat display is obtained by at least two cameras.

On the basis of the above embodiments, optionally, the size of each compensated first sub-image of the image along the first direction is larger than or equal to the size of one sub-pixel of the flat display along the first direction.

On the basis of the above embodiments, optionally, the image compensation chip is further configured to:

divide equally the image to be displayed into a plurality of second sub-images along a second direction parallel to the display surface of the flat display and perpendicular to the first direction; calculate a compensation ratio along the second direction for each second sub-image of the image according to the position information of the view point relative to the flat display and the parameter information of the second virtual section line segment; and compensate each second sub-image of the image along the second direction, where, the second virtual section line segment has two endpoints located on the frame of the display device, is extended along the second direction, and is extended through a projection of the view point onto the flat display.

The flat display is configured to display the compensated second sub-images, so that visual angles at the view point for the compensated second sub-images are equal.

In such configuration, advantageously, the flat display can simultaneously achieve the display effect of the curved-surface display in both the first direction and the second direction to improve visual experience.

Further, the size of each compensated second sub-image of the image along the second direction is larger than or equal to the size of one sub-pixel of the flat display along the second direction.

Optionally, the image compensation chip includes an image capture module, an image division module, a calculation module and a compensation module.

The image capture module is configured to capture an image to be displayed.

The image division module is configured to divide equally the captured image into a plurality of first sub-images along a first direction; and divide equally the captured image into a plurality of second sub-images along a second direction.

The calculation module is configured to calculate a compensation ratio along the first direction for each first sub-image of the image according to the position information of the view point relative to the flat display and the parameter information of the first virtual section line segment; and calculate a compensation ratio along the second direction for each second sub-image of the image according to the position information of the view point relative to the flat display and the parameter information of the second virtual section line segment.

The compensation module is configured to compensate each first sub-image of the image along the first direction according to the compensation ratio along the first direction for the first sub-image of the image; and compensate each second sub-image of the image along the second direction according to the compensation ratio along the second direction for the second sub-image of the image.

Further, the image displaying system further includes:

A storage device configured to store the parameter information of the first virtual section line segment of the flat display and the parameter information of the second virtual section line segment of the flat display.

Optionally, the calculation module includes:

An angle information calculation unit configured to calculate an angle between the first virtual section line segment and a line extending through both the view point and one of the two endpoints of the first virtual section line segment and an angle between the first virtual section line segment and a line extending through both the view point and the other of the two endpoints of the first virtual section line segment, according to the position information of the view point relative to the flat display and the parameter information of the first virtual section line segment of the flat display; and calculate an angle between the second virtual section line segment and a line extending through both the view point and one of the two endpoints of the second virtual section line segment, and an angle between the second virtual section line segment and a line extending through both the view point and the other of the two endpoints of the second virtual section line segment, according to the position information of the view point relative to the flat display and the parameter information of the second virtual section line segment of the flat display;

A virtual curved display plane calculation unit configured to determine a first virtual curved display plane according to the parameter information of the first virtual section line segment of the flat display, the angle between the first virtual section line segment and a line extending through both the view point and one of the two endpoints of the first virtual section line segment, and the angle between the first virtual section line segment and a line extending through both the view point and the other of the two endpoints of the first virtual section line segment; and determine a second virtual curved display plane according to the parameter information of the second virtual section line segment of the flat display, the angle between the second virtual section line segment and the line extending through both the view point and one of the two endpoints of the second virtual section line segment, and the angle between the second virtual section line segment and the line extending through both the view point and the other of the two endpoints of the second virtual section line segment;

An elemental display unit division unit configured to divide equally the first virtual curved display plane into a plurality of first elemental display units along a first curved line, and obtain the arc length of each of the first elemental display units along the first curved line, where each of the plurality of first elemental display units corresponds to one of the plurality of first sub-images; and divide equally the second virtual curved display plane into a plurality of second elemental display units along a second direction, and obtain the arc length of each of the second elemental display units along the second direction, where each of the plurality of second elemental display units corresponds to one of the plurality of second sub-images; and A compensation ratio calculation unit configured to calculate the compensation ratio along the first direction for each first sub-image of the image to be displayed, according to the parameter information of the first virtual section line segment of the flat display, the angle between the first virtual section line segment and a line extending through both the view point and one of the two endpoints of the first virtual section line segment, the angle between the first virtual section line segment and a line extending through both the view point and the other of the two endpoints of the first virtual section line segment, and the arc length of each of the first elemental display units along the first direction; and calculate a compensation ratio along the second direction for each second sub-image of the image to be displayed, according to the parameter information of the second virtual section line segment of the flat display, the angle between the second virtual section line segment and the line extending through both the view point and one of the two endpoints of the second virtual section line segment, the angle between the second virtual section line segment and the line extending through both the view point and the other of the two endpoints of the second virtual section line segment, and the arc length of each of the second elemental display units along the second direction.

Optionally, the compensation ratio calculation unit includes:

A distance calculation sub-unit configured to calculate a curvature radius of the first virtual curved display plane and the distance from the view point to the flat display, according to the parameter information of the first virtual section line segment, the angle between the first virtual section line segment and a line extending through both the view point and one of the two endpoints of the first virtual section line segment, and the angle between the first virtual section line segment and a line extending through both the view point and the other of the two endpoints of the first virtual section line segment; and calculate a curvature radius of the second virtual curved display plane, according to the parameter information of the second virtual section line segment, the angle between the second virtual section line segment and a line extending through both the view point and one of the two endpoints of the second virtual section line segment, and the angle between the second virtual section line segment and a line extending through both the view point and the other of the two endpoints of the second virtual section line segment;

A positioning sequence number sub-unit configured to determine a positioning sequence number of each first sub-image of the image along the first direction according to the parameter information of the first virtual section line segment, the angle between the first virtual section line segment and a line extending through both the view point and one of the two endpoints of the first virtual section line segment, the angle between the first virtual section line segment and a line extending through both the view point and the other of the two endpoints of the first virtual section line segment; and determine a positioning sequence number of each second sub-image of the image along the second direction according to the parameter information of the second virtual section line segment, the angle between the second virtual section line segment and a line extending through both the view point and one of the two endpoints of the second virtual section line segment, the angle between the second virtual section line segment and a line extending through both the view point and the other of the two endpoints of the second virtual section line segment; and A compensation ratio calculation sub-unit configured to calculate the compensation ratio along the first direction for each first sub-image of the image to be displayed, according to the positioning sequence number of each first sub-image of the image along the first direction, the curvature radius of the first virtual curved display plane, the distance from the view point to the flat display, and the arc length of each of the first elemental display units along the first direction; and calculate the compensation ratio along the second direction for each second sub-image of the image to be displayed, according to the positioning sequence number of each second sub-image of the image along the second direction, the curvature radius of the second virtual curved display plane, the distance from the view point to the flat display, and the arc length of each of the second elemental display units along the second direction.

It should be noted that the above description describes embodiments and technical principles of the disclosure. Those skilled in this art will understand that the disclosure is not limited to the specific embodiments described herein, and various apparent changes, rearrangements and substitutions may be made without departing from the protecting scope of the disclosure. Therefore, although the disclosure has been described in detail as above in connection with the embodiments, the disclosure is not limited thereto and may include other embodiments without departing from the scope of the disclosure Various modifications and additions can be made to the exemplary embodiments discussed without departing from the scope of the disclosure. For example, while the embodiments described above refer to particular features, the scope of this disclosure also includes embodiments having different combinations of features and embodiments that do not include all of the described features. Accordingly, the scope of the disclosure is intended to embrace all such alternatives, modifications, and variations as fall within the scope of the claims, together with all equivalents thereof.

I claim:

1. An image displaying method, comprising:

obtaining an image to be displayed on a flat display, and dividing equally the image to be displayed into n first sub-images along a first direction parallel to a display surface of the flat display, wherein each of the n first sub-images has a length a in the first direction;

obtaining position information of a view point relative to the flat display and parameter information of a first virtual section line segment of the flat display, wherein the first virtual section line segment has a start point and an endpoint both located on a frame of the flat display, is extended along the first direction, and is extended through a projection of the view point onto the flat display;

calculating n size compensation ratios k for the n first sub-images respectively, according to the position information of the view point relative to the flat display and the parameter information of the first virtual section line segment;

obtaining n second sub-images based on the n size compensation ratios k and the n first sub-images, wherein a length $b_i$ of the ith of the n second sub-images along the first direction is equal to $a*k_i$, $k_i$ is the size compensation ratio of the ith first sub-image, where $1 \le i \le n$; and displaying the second sub-image on the flat display, so that visual angles at the view point with respect to the second sub-images are equal.

2. The method of claim 1, further comprising:

dividing equally the image to be displayed into m third sub-images along a second direction parallel to the display surface of the flat display and perpendicular to the first direction, wherein each of the m third sub-images has a length c in the second direction;

obtaining parameter information of a second virtual section line segment of the flat display, wherein the second virtual section line segment has a start point and an endpoint both located on the frame of the display device, is extended along the second direction, and is extended through the projection of the view point onto the flat display;

calculating m size compensation ratios λ for the m third sub-images respectively, according to the position information of the view point relative to the flat display and the parameter information of the second virtual section line segment;

obtaining m fourth sub-images based on the m size compensation ratios λ and the m third sub-images, wherein a length $d_i$ of the ith of the m fourth sub-images in the second direction is equal to $c*\lambda_i$, $\lambda_i$ is the size compensation ratio of the ith third sub-image, where $1 \le i \le$; and displaying the fourth sub-image on the flat display, so that visual angles at the view point with respect to the fourth sub-images are equal.

3. The method of claim 2, wherein the step of calculating m size compensation ratios λ for the m third sub-images respectively according to the position information of the view point relative to the flat display and the parameter information of the second virtual section line segment comprises:

calculating an angle between the second virtual section line segment and a line extending through both the view point and one of the start point and the endpoint of the second virtual section line segment, and an angle between the second virtual section line segment and a line extending through both the view point and the other of the start point and the endpoint of the second virtual section line segment, according to the position information of the view point relative to the flat display and the parameter information of the second virtual section line segment;

determining a second virtual curved display plane according to the parameter information of the second virtual section line segment, the angle between the second virtual section line segment and the line extending through both the view point and one of the start point and the endpoint of the second virtual section line segment, and the angle between the second virtual section line segment and the line extending through both the view point and the other of the start point and the endpoint of the second virtual section line segment, wherein the second virtual curved display plane contains the second curved line;

dividing equally the second virtual curved display plane into m second elemental display units along the second direction, and obtaining an arc length of each of the second elemental display units along the second direction, wherein each of the m second elemental display units corresponds to a respective one of m third sub-images; and calculating the m size compensation ratios λ according to the parameter information of the second virtual section line segment, the angle between the second virtual section line segment and the line extending through both the view point and one of the start point and the endpoint of the second virtual section line segment, the angle between the second virtual section line segment and the line extending through both the view point and the other of the start point and the endpoint of the second virtual section line segment, and the arc length of each of the second elemental display units along the second direction.

4. The method of claim 3, wherein the step of calculating the m size compensation ratios λ according to the parameter information of the second virtual section line segment, the angle between the second virtual section line segment and the line extending through both the view point and one of the start point and the endpoint of the second virtual section line segment, the angle between the second virtual section line segment and the line extending through both the view point and the other of the start point and the endpoint of the second virtual section line segment, and the arc length of each of the second elemental display units along the second direction comprises:

calculating a curvature radius of the second virtual curved display plane, according to the parameter information of the second virtual section line segment, the angle between the second virtual section line segment and the line extending through both the view point and one of the start point and the endpoint of the second virtual section line segment, and the angle between the second virtual section line segment and the line extending through both the view point and the other of the start point and the endpoint of the second virtual section line segment;

determining a positioning sequence number of each second sub-image of the image along the second direction according to the parameter information of the second virtual section line segment, the angle between the second virtual section line segment and the line extending through both the view point and one of the start point and the endpoint of the second virtual section line segment, and the angle between the second virtual section line segment and the line extending through both the view point and the other of the start point and the endpoint of the second virtual section line segment; and calculating the m size compensation ratios λ according to the positioning sequence number of each third sub-image of the image along the second direction, the curvature radius of the second virtual curved display plane, the distance from the view point to the flat display, and the arc length of each of the second elemental display units along the second direction.

5. The method of claim 1, wherein the position information of the view point relative to the flat display is obtained by a position detector.

6. The method of claim 5, wherein the position detector comprises at least two cameras.

7. The method of claim 5, wherein the step of calculating n size compensation ratios k for the n first sub-images respectively comprises:

calculating an angle between the first virtual section line segment and a line extending through both the view point and one of the start point and the endpoint of the first virtual section line segment and an angle between the first virtual section line segment and a line extending through both the view point and the other of the start point and the endpoint of the first virtual section line segment, according to the position information of the view point relative to the flat display and the parameter information of the first virtual section line segment;

determining a first virtual curved display plane according to the parameter information of the first virtual section line segment, the angle between the first virtual section line segment and the line extending through both the view point and one of the start point and the endpoint of the first virtual section line segment, and the angle between the first virtual section line segment and the line extending through both the view point and the other of the start point and the endpoint of the first virtual section line segment, wherein the first virtual curved display plane extends along a first curved line;

dividing equally the first virtual curved display plane into n first elemental display units along the first curved line, and obtaining an arc length of each of the first elemental display units along the first curved line, wherein each of the n first elemental display units corresponds to a respective one of the n first sub-images; and calculating the n size compensation ratios k according to the parameter information of the first virtual section line segment, the angle between the first virtual section line segment and the line extending through both the view point and one of the start point and the endpoint of the first virtual section line segment, the angle between the first virtual section line segment and the line extending through both the view point and the other of the start point and the endpoint of the first virtual section line segment, and the arc length of each of the first elemental display units along the first direction.

8. The method of claim 7, wherein the step of calculating the n size compensation ratios k according to the parameter information of the first virtual section line segment, the angle between the first virtual section line segment and the line extending through both the view point and one of the start point and the endpoint of the first virtual section line segment, the angle between the first virtual section line segment and the line extending through both the view point and the other of the start point and the endpoint of the first virtual section line segment, and the arc length of each of the first elemental display units along the first direction comprises:

calculating a curvature radius of the first virtual curved display plane and a distance from the view point to the flat display, according to the parameter information of the first virtual section line segment, the angle between the first virtual section line segment and the line extending through both the view point and one of the start point and the endpoint of the first virtual section line segment, and the angle between the first virtual section line segment and the line extending through both the view point and the other of the start point and the endpoint of the first virtual section line segment;

determining a positioning sequence number of each first sub-image of the image along the first direction according to the parameter information of the first virtual section line segment, the angle between the first virtual section line segment and the line extending through both the view point and one of the start point and the endpoint of the first virtual section line segment, and the angle between the first virtual section line segment and the line extending through both the view point and the other of the start point and the endpoint of the first virtual section line segment; and calculating the n size compensation ratios k according to the positioning sequence number of each first sub-image of the image along the first direction, the curvature radius of the first virtual curved display plane, the distance from the view point to the flat display, and the arc length of each of the first elemental display units along the first direction.

9. The image displaying method of claim 8, wherein the step of calculating the n size compensation ratios k according to the positioning sequence number of each first sub-image of the image along the first direction, the curvature radius of the first virtual curved display plane, the distance from the view point to the flat display, and the arc length of each of the first elemental display units along the first direction is based on the following formula:

$$k_i = C\left[\tan\left(\frac{i * X0}{R}\right) - \tan\left(\frac{i * X0 - Xo}{R}\right)\right],$$

wherein C denotes the distance from the view point to the flat display and is calculated according to formula:

$$C = \frac{L1 * \tan\theta 1}{\frac{\tan\theta_1}{\tan\theta_2} + 1};$$

R denotes the curvature radius of the first virtual curved display plane and is a greater one of $$\frac{L1 * \sec\theta 2}{\frac{\tan\theta_2}{\tan\theta_1} + 1} \text{ and } \frac{L1 * \sec\theta 1}{\frac{\tan\theta_2}{\tan\theta_1} + 1};$$

L1 denotes a length of the first virtual section line segment;

θ1 denotes the angle between the first virtual section line segment and the line extending through both the view point and the start end of the first virtual section line segment, θ2 denotes the angle between the first virtual section line segment and the line extending through both the view point and the endpoint of the first virtual section line segment, and x0 denotes the arc length of each of the first elemental display units along the first direction.

10. An image displaying system, comprising a flat display, a position detector and an image compensation chip; wherein the position detector is disposed on a frame of the flat display and configured to obtain position information of a view point relative to the flat display; the image compensation chip is disposed on a driving panel of the flat display and configured to:

divide equally an image to be displayed on the flat display into n first sub-images along a first direction parallel to a display surface of the flat display, wherein each of the n first sub-images has a length a in the first direction;

calculate n size compensation ratios k for the n first sub-images respectively according to the position information of the view point relative to the flat display and parameter information of a first virtual section line segment of the flat display;

obtain n second sub-images based on the n size compensation ratios k and the n first sub-images, wherein a length $b_i$ of the ith of the n second sub-images along the first direction is equal to $a*k_i$, $k_i$ is the size compensation ratio of the ith first sub-image, where $1 \le i \le n$, the first direction is parallel to the display surface of the flat display, and the first virtual section line segment has start point and the endpoint located on the frame of the flat display, is extended along the first direction, and is extended through a projection of the view point onto the flat display; and the flat display is configured to display the second sub-images so that visual angles at the view point for the second sub-images are equal.

11. The system of claim 10, wherein the position detector comprises at least two cameras.

12. The system of claim 10, wherein, the image compensation chip is further configured to:

divide equally the image to be displayed into m third sub-images along a second direction parallel to the display surface of the flat display and perpendicular to the first direction, wherein each of the m third sub-images has a length c in the second direction;

calculate m size compensation ratios λ for the m third sub-images respectively according to the position information of the view point relative to the flat display and the parameter information of a second virtual section line segment of the flat display;

obtain m fourth sub-images based on the m size compensation ratios λ and the m third sub-images, wherein a length $d_i$ of the ith of the m fourth sub-images in the second direction is equal to $c*\lambda_i$, $\lambda_i$ is the size compensation ratio of the ith third sub-image, and $1 \le i \le m$, the second virtual section line segment has start point and the endpoint located on the frame of the display device, is extended along the second direction, and is extended through the projection of the view point onto the flat display; and the flat display is configured to display the fourth sub-images, so that visual angles at the view point for the fourth sub-images are equal.

13. The system of claim 12, wherein the image compensation chip comprises an image capture module, an image division module, a calculation module and a compensation module; wherein, the image capture module is configured to capture the image to be displayed;

the image division module is configured to divide equally the captured image into the n first sub-images along the first direction; and divide equally the captured image into the n sub-images along the second direction;

the calculation module is configured to calculate the n size compensation ratios k according to the position information of the view point relative to the flat display and the parameter information of the first virtual section line segment, and calculate the m size compensation ratios λ according to the position information of the view point relative to the flat display and the parameter information of the second virtual section line segment; and the compensation module is configured to obtain n second sub-images based on the n size compensation ratios k and the n first sub-images and obtain m fourth sub-images based on the m size compensation ratios λ and the m third sub-images.

14. The system of claim 13, further comprising a storage device configured to store the parameter information of the first virtual section line segment of the flat display and the parameter information of the second virtual section line segment of the flat display.

15. The system of claim 13, wherein the calculation module comprises:

an angle information calculation unit configured to calculate an angle between the first virtual section line segment and a line extending through both the view point and one of the start point and the endpoint of the first virtual section line segment and an angle between the first virtual section line segment and a line extending through both the view point and the other of the start point and the endpoint of the first virtual section line segment, according to the position information of the view point relative to the flat display and the parameter information of the first virtual section line segment of the flat display, and calculate an angle between the second virtual section line segment and a line extending through both the view point and one of the start point and the endpoint of the second virtual section line segment, and an angle between the second virtual section line segment and a line extending through both the view point and the other of the start point and the endpoint of the second virtual section line segment, according to the position information of the view point relative to the flat display and the parameter information of the second virtual section line segment of the flat display;

a virtual curved display plane calculation unit configured to determine a first virtual curved display plane, according to the parameter information of the first virtual section line segment of the flat display, the angle between the first virtual section line segment and the line extending through both the view point and one of the start point and the endpoint of the first virtual section line segment, and the angle between the first virtual section line segment and the line extending through both the view point and the other of the start point and the endpoint of the first virtual section line segment; and determine a second virtual curved display plane, according to the parameter information of the second virtual section line segment of the flat display, the angle between the second virtual section line segment and the line extending through both the view point and one of the start point and the endpoint of the second virtual section line segment, and the angle between the second virtual section line segment and the line extending through both the view point and the other of the start point and the endpoint of the second virtual section line segment;

an elemental display unit division unit configured to divide equally the first virtual curved display plane into n first elemental display units along a first curved line, and obtain an arc length of each of the first elemental display units along the first curved line, wherein each of the n first elemental display units corresponds to a respective one of the n first sub-images; and divide equally the second virtual curved display plane into m second elemental display units along the second direction, and obtain an arc length of each of the second elemental display units along the second direction, wherein each of the m second elemental display units corresponds to a respective one of the m third sub-images; and a size compensation ratio calculation unit configured to calculate the n size compensation ratios k according to the parameter information of the first virtual section line segment of the flat display, the angle between the first virtual section line segment and the line extending through both the view point and one of the start point and the endpoint of the first virtual section line segment, the angle between the first virtual section line segment and the line extending through both the view point and the other of the start point and the endpoint of the first virtual section line segment, and the arc length of each of the first elemental display units along the first direction, and calculate the m size compensation ratios λ according to the parameter information of the second virtual section line segment of the flat display, the angle between the second virtual section line segment and the line extending through both the view point and one of the start point and the endpoint of the second virtual section line segment, the angle between the second virtual section line segment and the line extending through both the view point and the other of the start point and the endpoint of the second virtual section line segment, and the arc length of each of the second elemental display units along the second direction.

16. The system of claim 15, wherein the compensation ratio calculation unit comprises:

a distance calculation sub-unit configured to calculate a curvature radius of the first virtual curved display plane and a distance from the view point to the flat display, according to the parameter information of the first virtual section line segment, the angle between the first virtual section line segment and the line extending through both the view point and one of the start point and the endpoint of the first virtual section line segment, and the angle between the first virtual section line segment and the line extending through both the view point and the other of the start point and the endpoint of the first virtual section line segment, and calculate a curvature radius of the second virtual curved display plane, according to the parameter information of the second virtual section line segment, the angle between the second virtual section line segment and the line extending through both the view point and one of the start point and the endpoint of the second virtual section line segment, and the angle between the second virtual section line segment and the line extending through both the view point and the other of the start point and the endpoint of the second virtual section line segment;

a positioning sequence number sub-unit configured to determine a positioning sequence number of each first sub-image of the image along the first direction according to the parameter information of the first virtual section line segment, the angle between the first virtual section line segment and line extending through both the view point and one of the start point and the endpoint of the first virtual section line segment, and the angle between the first virtual section line segment and the line extending through both the view point and the other of the start point and the endpoint of the first virtual section line segment, and determine a positioning sequence number of each third sub-image of the image along the second direction according to the parameter information of the second virtual section line segment, the angle between the second virtual section line segment and the line extending through both the view point and one of the start point and the endpoint of the second virtual section line segment, and the angle between the second virtual section line segment and the line extending through both the view point and the other of the start point and the endpoint of the second virtual section line segment; and a size compensation ratio calculation sub-unit configured to calculate the n size compensation ratios k according to the positioning sequence number of each first sub-image of the image along the first direction, the curvature radius of the first virtual curved display plane, the distance from the view point to the flat display, and the arc length of each of the first elemental display units along the first direction, and calculate the m size compensation ratios λ according to the positioning sequence number of each third sub-image of the image along the second direction, the curvature radius of the second virtual curved display plane, the distance from the view point to the flat display, and the arc length of each of the second elemental display units along the second direction.

17. The system of claim 16, wherein the size compensation ratio calculation sub-unit is configured to calculation sub-unit configured to calculate the n size compensation ratios k based on the following formula:

$$k_i = C\left[\tan\left(\frac{i * X0}{R}\right) - \tan\left(\frac{i * X0 - Xo}{R}\right)\right],$$

wherein C denotes the distance from the view point to the flat display and is calculated according to formula:

$$C = \frac{L1 * \tan\theta 1}{\frac{\tan\theta_1}{\tan\theta_2} + 1};$$

R denotes the curvature radius of the first virtual curved display plane and is a greater one of $$\frac{L1 * \sec\theta 2}{\frac{\tan\theta_2}{\tan\theta_1} + 1} \text{ and } \frac{L1 * \sec\theta 1}{\frac{\tan\theta_2}{\tan\theta_1} + 1};$$

L1 denotes a length of the first virtual section line segment;

θ1 denotes the angle between the first virtual section line segment and the line extending through both the view point and the start end of the first virtual section line segment, θ2 denotes the angle between the first virtual section line segment and the line extending through both the view point and the endpoint of the first virtual section line segment, and x0 denotes the arc length of each of the first elemental display units along the first direction.

* * * * *